United States Patent [19]

Bach

[11] Patent Number: 4,715,832

[45] Date of Patent: Dec. 29, 1987

[54] CURRENT-CARRYING ELEMENT

[75] Inventor: Erik Bach, Billund, Denmark

[73] Assignee: Interlego A.G., Baar, Switzerland

[21] Appl. No.: 852,664

[22] PCT Filed: Aug. 2, 1985

[86] PCT No.: PCT/DK85/00074

§ 371 Date: May 1, 1986

§ 102(e) Date: May 1, 1986

[87] PCT Pub. No.: WO86/01343

PCT Pub. Date: Feb. 27, 1986

[30] Foreign Application Priority Data

Aug. 3, 1984 [DK] Denmark ..... 3768/84

[51] Int. Cl.[4] ..... H01R 11/09

[52] U.S. Cl. ..... 439/723; 439/741; 439/715

[58] Field of Search ..... 339/17 LM, 17 M, 18 R, 339/18 C, 18 P, 177, 143 R, 166 R, 19; 361/392, 393

[56] References Cited

U.S. PATENT DOCUMENTS

| | | | |
|---|---|---|---|
| 2,762,024 | 9/1956 | Heath | 339/214 R |
| 2,977,562 | 3/1961 | Benson | 339/166 R |
| 3,027,534 | 3/1962 | Deakin | 339/18 C |
| 3,377,607 | 4/1968 | Deakin | 339/177 R |

*Primary Examiner*—Gil Weidenfeld
*Assistant Examiner*—David Pirlot
*Attorney, Agent, or Firm*—Kane, Dalsimer, Sullivan, Kurucz, Levy, Eisele and Richard

[57] ABSTRACT

In a building element of the special type which in addition to being provided with coupling means for mechanical intercoupling of the building blocks-contains current-carrying components placed in the electrically insulated building block (2). There are provided at least two current-carrying components (3, 4) with respective contact areas which are mutually co-axially positioned. Hereby building blocks (2) of this type can be intercoupled mechanically while establishing electrical connection between the respective current rails (3, 4) in the cooperating building elements, without any risk of short circuiting between the two current-carrying components, no matter how the building blocks are intercoupled mechanically.

11 Claims, 13 Drawing Figures

Figures 1, 2, 3:
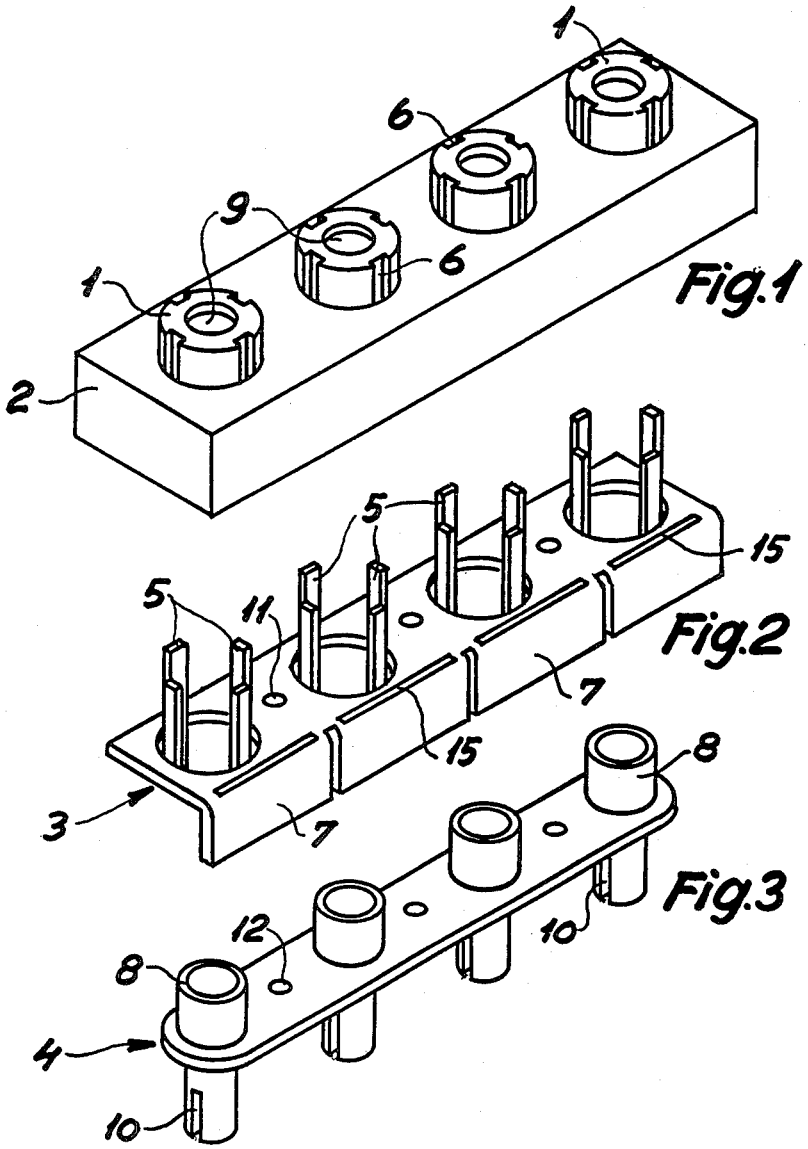

1
6
9
6
1
2

5
15
5
11

7
15
3
7
8

12
10
8
4
10

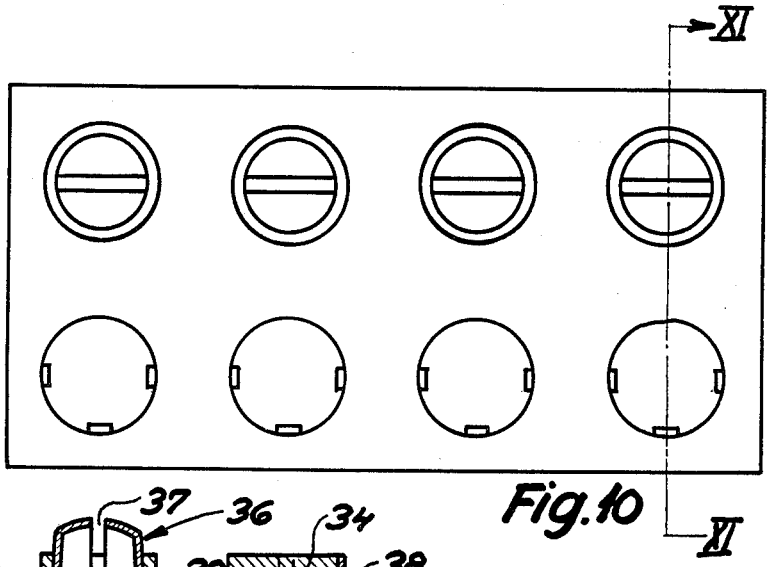
Fig.10
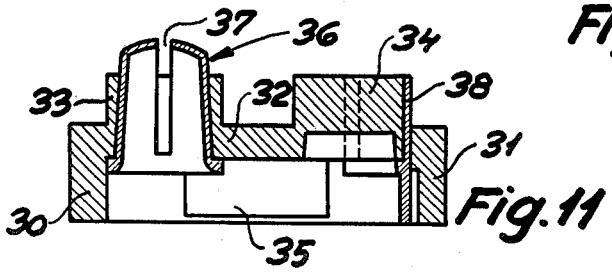
Fig.11
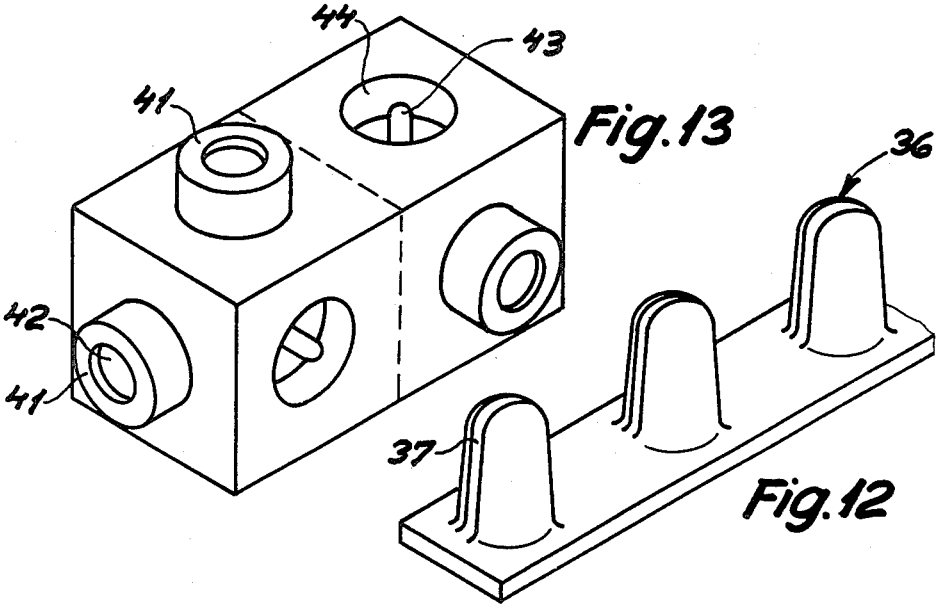
Fig.13
Fig.12

CURRENT-CARRYING ELEMENT

A building element for a building set, said element comprising a plurality of contiguous, square module units, at least some of which have a coupling stud protruding co-axially with a central axis of the module unit, so that the mutual centre-to-centre distance of the coupling studs is equal to a multiple of the module measure, said element moreover comprising complementary coupling means for cooperation with coupling studs on an adjacent element for mechanical intercoupling of the elements, and having at least two mutually electrically insulated current paths, a first current path being connected to first contact areas in the element and designed to establish electrical connection with the first current path in an adjacent element, a second current path being connected to second contact areas in the element and designed to establish electrical connection with the second current path in the adjacent element.

For example the Swiss patent specification No. 455 606 discloses a toy building set whose building blocks are provided with conductive areas for conduction of electric current when the building elements are coupled together. This conduction, however, just concerns unipolar current, but it is known in principle from the German Offenlegungsschrift No. 25 52 587 that a building block may contain several current paths, where, of course, short circuiting between these current paths is to be avoided. How the short circuiting is to be avoided in practice, however, is not known.

The object of the invention is to provide a building element of the present type where the contact areas for the current paths are so placed as to provide, on one hand, security against short circuiting and, on the other, additional advantages, as will be explained below.

Security against short circuiting is obtained by the co-axial location of the first and the second contact areas, as stated in the characterizing portion of claim 1, and since at least the first contact areas are positioned within the coupling stud, external access to the associated current path is difficult, partly with respect to direct contact and partly with respect to the risk of external short circuiting to the other current path. When the contact areas of at least one current path are positioned within the radial extent of the coupling studs, an additional advantage is obtained. This advantage is brought about in that the coupling studs extend an axial distance from the building element, and because of this axial length the first contact areas can be so shaped that the building element can be coupled with a corresponding building element without electric current paths. Further, the height of the coupling studs allows the contact areas to be made resilient.

Claim 2 defines a first embodiment of the building element of the invention, where each of the coupling studs of the building element is provided both with said first and said second contact areas. It should be mentioned here that the building element of claim 1 is not conditional upon some specially shaped mechanical coupling means. Thus, there may be building elements of such a structure that the embodiment defined in claim 2 is expedient. In other constructions, the embodiment defined in claim 3 may be expedient, and it is usually less complicated to manufacture since only one type of contact areas is to be provided for one row of coupling studs, while only the second type of contact areas is to be provided for the second row of coupling studs.

When two building elements of the last-mentioned type are coupled together mechanically, both current paths will normally be interconnected, and the risk of short circuiting is eliminated.

Claim 4 defines a first embodiment of the first contact areas, while claims 5 and 6 define an embodiment of the second contact areas. It will be noted that the embodiment defined in claim 4 presupposes that the other elements of the building set, which do not contain electric current paths, must also have a central hole in the coupling studs in order for them to be coupled together with the building element of the invention. The latter condition is not necessary in connection with the embodiment defined in claim 7 where the first contact areas are resilient, which, as mentioned before, is based upon a relatively great travel as a consequence of the height of the coupling stud. Claim 8 defines a preferred embodiment of the first contact means, wherein these are very simple and inexpensive to manufacture, and claim 9 defines another expedient detail which causes the cooperating edges to scrape slightly against each other when two adjacent elements are coupled together, thereby providing a very safe and stable electrical connection.

However, the height of the coupling studs can also be used for making the first contact areas resilient in a direction which is substantially perpendicular to the central axis of the associated coupling stud, cf. claim 10. The contact areas might be some tongues which are fixed in the building element, but, preferably, the contact areas are shaped as stated in claim 11, where the conical shape of the bushing entails that the relatively thin portion of the bushing can be inserted into the relatively thick portion of the bushing. Such bushings can be pressed from a metal strip, and claim 11 therefore defines a very inexpensive embodiment.

Figure 4:
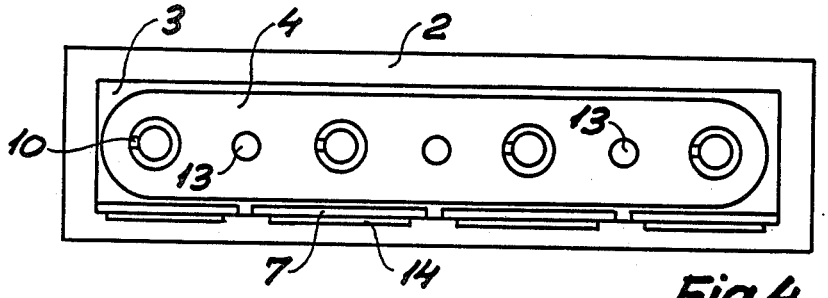
Figure 5:
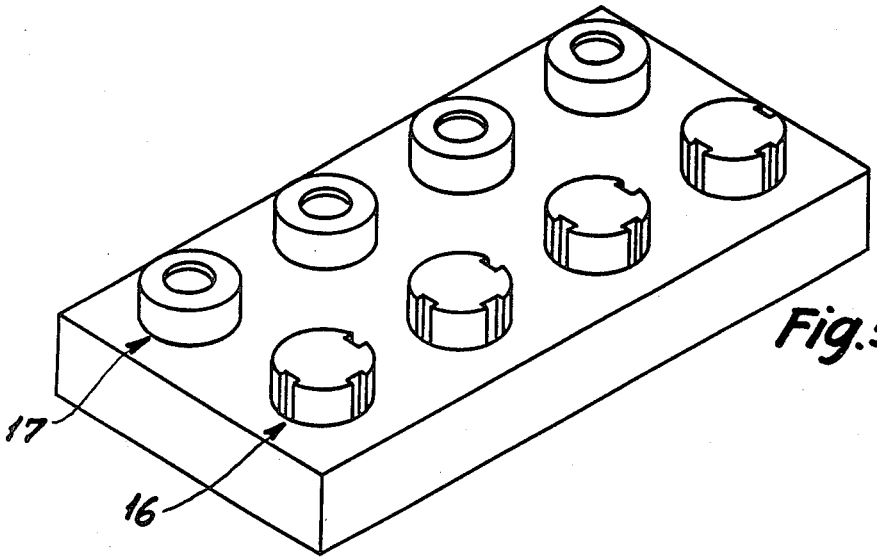
Figure 6:
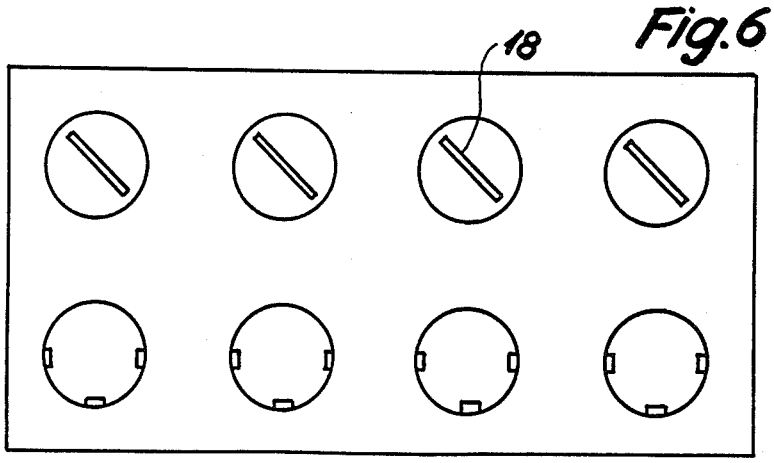
Figure 7:
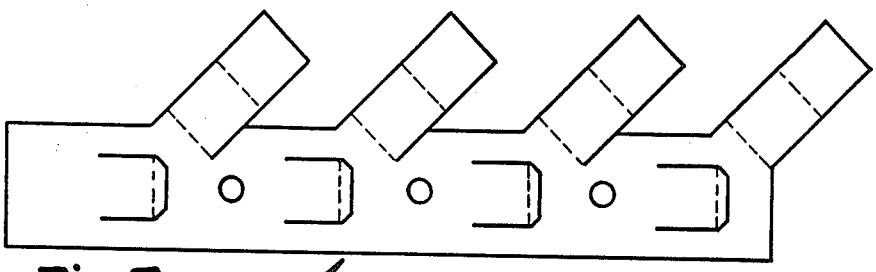
Figure 8:
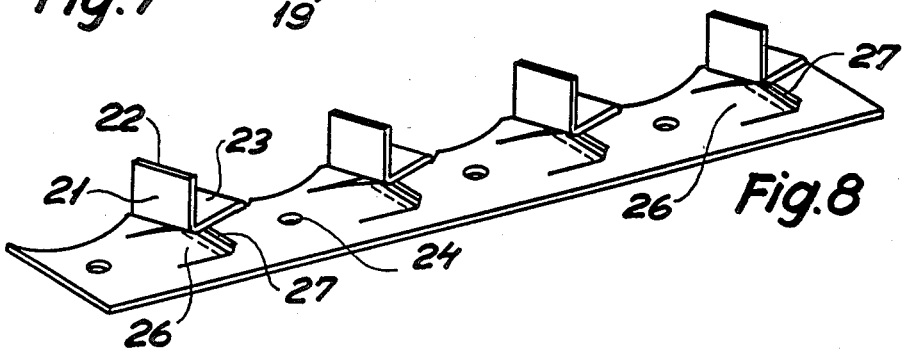
Figure 9:
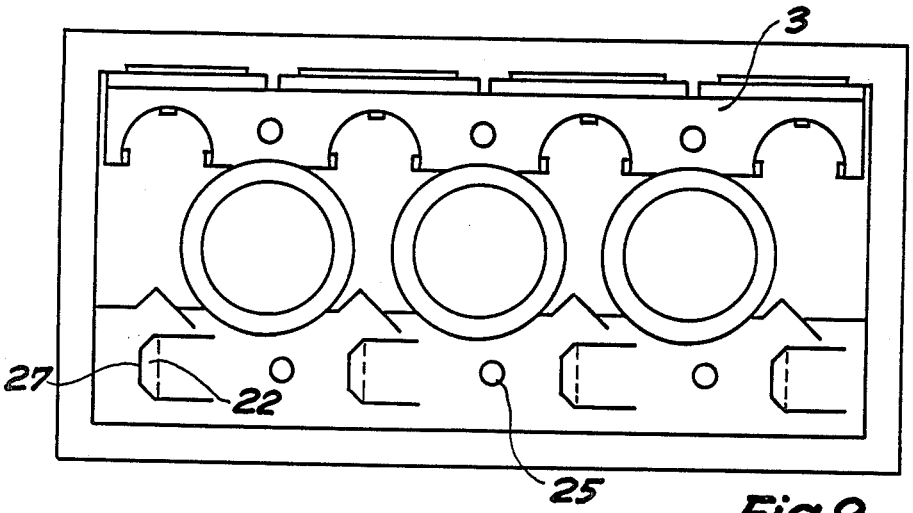

The invention will be explained more fully by the following description of some embodiments with reference to the drawing, in which FIG. 1 shows a first embodiment of the building element of the invention, FIGS. 2 and 3 show electrically conductive members incorporated in the otherwise electrically insulated element from FIG. 1, FIG. 4 is a bottom view of the building element from FIG. 1, after the electrically conductive members have been mounted, FIG. 5 shows a second embodiment of the element of the invention, FIG. 6 shows a third embodiment of the building element of the invention, FIGS. 7 and 8 show an embodiment of an electrically conductive member for incorporation in the element of FIG. 6, FIG. 9 is a bottom view of the building element from FIG. 6, after the electrically conductive members have been mounted, FIG. 10 shows a further embodiment of the building element of the invention, FIG. 11 is a section along the line XI-XI in FIG. 10, FIG. 12 shows a metal rail for the embodiment shown in FIG. 10, while FIG. 13 shows still another embodiment of the building element of the invention.

The embodiment of the building element of the invention shown in FIG. 1 comprises just four coupling studs 1 which are disposed in a row and extend from the top side of a hollow box 2. The bottom of the box 2 is open in a known manner and contains means for mechanical cooperation with coupling studs on another building element, so that two adjacent building elements can be coupled together mechanically. When the elements are coupled together mechanically, electrical connection is established between two current paths in the element, as will be explained below.

FIG. 2 shows an electrically conductive member 3 to provide a current path in the building element, while FIG. 3 shows an electrically conductive member 4 to provide an additional current path in the building element.

The conductive member 3 shown in FIG. 2 is punched and pressed from a single piece of sheet metal, so that, for each coupling stud, four legs 5 are provided which are designed to be received in their respective grooves 6 in the associated coupling stud. The electrically conductive member 3 moreover comprises a bent flap 7 adjacent each of the four coupling studs 1 shown in FIG. 1. The building element shown in FIG. 1 is manufactured from an electrically insulating material and is designed to receive the electrically conductive member 3, so that the curved surface of each of the coupling studs comprises four electrically conductive contact areas, all of these contact areas being interconnected.

The electrically conductive member 4 shown in FIG. 3 comprises four electrically conductive bushings 8, which are co-axially flush with their respective coupling studs 1 when the electrically conductive member 4 is mounted in the building element shown in FIG. 1. The bushings, which are interconnected by means of a metal rail, have, at one side of the rail, an outside diameter which corresponds to the diameter of an axial hole 9 in each coupling stud, and an inside diameter which corresponds to the outside diameter of the portion of the bushing extending to the other side of the rail. The last-mentioned portion is provided with at least one slit 10 so that the bushing is resilient. The electrically conductive member 4 is designed to be received in the building element shown in FIG. 1, as will be explained in connection with FIG. 4. FIG. 4 is a bottom view of the building element shown in FIG. 1, after the electrically conductive members 3, 4 have been mounted. In the mounting, the electrically conductive member 4 is first placed in position, the resilient legs 5 being inserted into the through grooves 6 until the member 3 has been pushed home in the building element. As appears from FIG. 4, the cavity 3 of the building element accomodates protruding pins 13 which are received in holes 11 in the electrically conductive member 3. The electrically conductive member 4 has corresponding holes 12 to receive the pins 13 when the electrically conductive member 4 is pushed in position in the building element from FIG. 1. Hereby the bushings 8 are moved into the holes 9 in each of the coupling studs 1. Since the electrically conductive members 3, 4 constitute their respective electric current paths, the members must of course not short circuit, which is avoided by spacing the members and/or by placing an electrically insulating sheet between the members. When the electrically conductive members are correctly positioned in the building element, they can be fixed by heat deformation of the pins 13.

As appears from FIG. 4, one of the side walls of the elements is provided with recesses 14 on the inside, so that the flaps 7 on the member 3 are supported only at the ends. In connection with the cut-outs 15 shown in FIG. 2, the advantage is that the flaps 7 are resilient transversely to the said side wall. When two building elements are coupled together mechanically, at least one of the resilient legs 5 touches one of the flaps 7 in the adjacent element, so as to provide electrical connection between one of the current paths in each building element. As mentioned, the flaps 7 can be resilient, but alternatively or in combination with this, the contact legs 5 may be resilient as they may be bent slightly outwards in the middle and can thus be resilient in the grooves 6. Though it is not shown in the drawing, it will be appreciated that the resilient legs 5 are preferably bent a distance inward at the top so that the building elements can be coupled without any risk of damage to the resilient legs 5. It will moreover be appreciated that the electrically conductive members 4 in two coupled elements establish electrical connection with each other, and this connection is reliable because of the slits 10 in the bushings 8.

It will be appreciated that concrete embodiments of the mechanical coupling means are conceivable which may cause practical problems in connection with the mounting of the electrically conductive members 3, 4. FIG. 5 shows an embodiment which, normally, brings about a significant simplification of the manufacturing method, there being two rows 16, 17 of coupling studs, one electrically conductive member being mounted in connection with one row 16, the other electrically conductive member being mounted in connection with the other row 17 of coupling studs. This structure entails that three resilient legs 5 on the member 3 (FIG. 2) are sufficient for each coupling stud. As was observed in connection with FIG. 1, the actual construction of the mechanically connectible means can, in the embodiment shown in FIG. 5, be of any type. However, it will be appreciated that the electrically conductive member 4 of FIG. 3 presupposes that all the elements of the building set have holes in the coupling studs to receive the bushings 8.

FIG. 6 is a top view of an embodiment of a building element of the invention, before the electrically conductive members have been mounted. This embodiment corresponds in principle to the embodiment shown in FIG. 5, except that the coupling studs in one row are each provided with an axial through slit 18 instead of the holes 9 from FIG. 1. The other row of coupling studs in FIG. 6 is designed to receive an electrically conductive member corresponding to the member 3 from FIG. 2, but with only three contact legs for each coupling stud.

FIG. 7 shows a metal piece 19 which is punched along the solid lines in the figure. The broken lines indicate after punching, resulting in the electrically conductive member 20 shown in FIG. 8. Thus, a flap 21 is provided adjacent each coupling stud, said flap extending through an associated slot 18 so that an edge 22 extends a small distance outside the coupling stud. The flap 21 can be pushed downward because of the resilient arm 23 so that the edge 22 is flush with the top side of the coupling stud. As shown in the figure, the electrically conductive member 20 has a plurality of holes 24, which serve to attach the member, as appears from FIG. 9, the holes 24 being designed to receive a projection 25 on the internal side of the building element. When the electrically conductive member 20 is mounted, the edge 22 can touch a corresponding electrically conductive member 20 in an adjacent element, but to obtain an electrical contact as stable as possible, there is provided a flap 26 adjacent each coupling stud, said flap being bent to the opposite side of the flap 21 and having an edge 27 which forms an angle with the edge 22. Thus, it will be appreciated that the edges are caused to scrape slightly against each other by the resilient cooperation, thereby providing a very safe and stable electrical connection.

As appears from FIG. 9, this embodiment of the builildng element is provided with secondary coupling tubes 28 for mechanical cooperation with the coupling studs of an adjacent element. It will be appreciated that the building element shown in FIGS. 6 and 9 can be coupled together with building elements with solid coupling studs, as the resilient flaps, in particular the flaps 21, can be received resiliently within the height of the coupling studs. The electrically conductive member 3 shown in FIG. 9 is mounted in the same manner as explained in connection with FIG. 4.

FIG. 10 shows an additional embodiment where each of the lower coupling studs is provided with three contact legs of the type shown in FIG. 2, and where the top row of the coupling studs each contains a metal bushing which extends a small distance axially outside the associated coupling stud. The structure of the electrically conductive members appears in more detail from FIGS. 11 and 12.

FIG. 11 shows the building element whose plastics members comprise side walls 30, 31, a top side 32 as well as coupling studs 33, 34. The figure moreover shows a secondary coupling tube 35 in the cavity of the building element. The row of coupling studs 33 has through bores to receive a respective bushing 36. Preferably, the bushings are made by deep-drawing of a metal strip, as shown in outline in FIG. 12. More particularly, each bushing is slightly conical and has an axial slit 37, which allows the tapering portion of the bushing, which protrudes from the coupling stud 33, to be slightly resilient in a direction perpendicular to the axis of the coupling stud. Moreover, the bushing is so dimensioned that the said tapering portion can be received resiliently in the thick portion of the bushing, thus providing a reliable electrical connection between the bushings in two coupled adjacent elements.

As appears from FIGS. 11 and 12, there are three contact legs for each of the coupling studs in the lower row in FIG. 10. FIG. 11 shows one leg 38 clearly, and it can moreover be seen that there is a small cavity in the wall 31 behind the flap 39, so that the flap can yield resiliently by cooperation with an adjacent element. As appears from FIG. 11, the underside of the coupling stud 34 must be provided with a recess 40 to receive a bushing from an adjacent element, it being observed that the bushing must not touch the contact portion carrying the contact legs.

In the embodiments described in the foregoing the building elements have been of a quite trivial type with one or two rows of coupling studs placed on one and the same side of the element. However, the invention is not restricted to such embodiments, and FIG. 13 is therefore included as an additional embodiment defining the more general conditions of the invention. The essential condition is that the building element may be perceived as being composed of a plurality of square module units, FIG. 13 showing five such square module units by means of the broken line, three of said units being provided with an axially protruding coupling stud, e.g. the coupling stud 41, while two module units do not have protruding coupling studs, but have complementary contact means in the shown embodiment. More particularly, each coupling stud can be provided with an internal bushing 42, all bushings being electrically interconnected and connected with electrically conductive projections like the one shown at 43. Each projection 43 is placed in a depression 44 designed to receive a coupling stud 41. The provision of electrically conductive and interconnected areas on the curved surface of the coupling studs and the curved surface of the coupling studs and the curved surface of the depression 44 results in a building element providing many possibilities of mechanical coupling, while providing electrical connection between two separate current circuits as well as security against mutual short circuiting of these current circuits. The contact means embodiment shown in FIG. 13 can in principle be compared with co-axial plugs so dimentioned and placed as to simultaneously serve as mechanical coupling means for building elements for a building set.

I claim:

1. A building element for a building set, said element being mechanically interconnectable with other similar elements in a number of different positions, each element comprising a plurality of contiguous, square module units having a common module measure, at least some of said units have a coupling stud protruding co-axially with a central axis of the module unit, so that the mutual centre-to-centre distance of the coupling studs is equal to a multiple of the module measure, said element moreover comprising complementary coupling means for cooperation with coupling studs on an adjacent element for mechanical intercoupling of the elements, and having at least two mutually electrically insulated current paths arranged so that when interconnected with an adjacent element a first current path is connected to first contact areas in the element to establish electrical connection with a corresponding first current path in the adjacent element, and a second current path being connected to second contact areas in the element to establish electrical connection with a corresponding second current path in the adjacent element, characterized in that the portions of the first current path contact areas designed to cooperate with an adjacent element are positioned within a plurality of areas co-axial with respective central axes and of a predetermined extent which is smaller than the cross section of the coupling studs, and that the second current path contact areas are positioned co-axially around the respective central axes, but outside the first current path contact areas.

2. A building element according to claim 1, characterized in that each coupling stud is provided with the first as well as with the second contact areas.

3. A building element according to claim 1, characterized in that one row of coupling studs is exclusively provided with said first contact areas, and that a second row of coupling studs is exclusively provided with said second contact areas.

4. A building element according to claim 1, characterized in that the first contact areas consist of electrically conductive bushings, each of which is received in a cavity in an associated coupling stud co-axially with the central axis thereof, and each of which has an electrically conductive pin extending axially away from the opening of the bushing and having an outside diameter which corresponds to the inside diameter of the bushing.

5. A building element according to claim 1, characterized in that the second contact areas are positioned on the outer side of respective coupling studs and are connected with a contact rail designed to cooperate electrically with second contact areas in an adjacent element.

6. A building element according to claim 5, characterized in that the second areas are mutually curvilinearly spaced around the associated coupling stud and consist of fingers punched from a metal piece and bent, said metal piece being designed to be attached in the building element so that the fingers are received in axial grooves in the curved surface of the coupling studs.

7. A building element according to claim 1, characterized in that the first contact areas are resilient in a direction which is substantially perpendicular to the central axis of the associated coupling stud.

8. A building element according to claim 7, characterized in that the first contact areas are formed by edges on metal flaps punched from and contiguous with a metal piece and bent to one side of the metal piece, said metal piece being designed to be attached interiorly in the element so that the free ends of the flaps extend through recesses in the surface of the coupling studs to resiliently engage a corresponding metal piece in an adjacent element.

9. A building element according to claim 8, characterized in that the metal piece has additional punched and bent metal flaps which each have an edge at one side of the metal piece to engage an edge disposed at one side of a metal piece in an adjacent element, so that the cooperating edges form a certain angle with each other.

10. A building element according to claim 1, characterized in that the first contact areas are resilient in a direction which is substantially perpendicular to the central axis of the associated coupling stud.

11. A building element according to claim 10, characterized in that the first contact areas each comprise a conical, axially slitted bushing, which extends a short axial distance outside the surface of the associated coupling stud.

* * * * *